US011057719B2

(12) United States Patent
Meier

(10) Patent No.: US 11,057,719 B2
(45) Date of Patent: Jul. 6, 2021

(54) HEARING DEVICE, A SOUND RECEIVING ARRANGEMENT, A SET OF PARTS AND A HEARING DEVICE SYSTEM

(71) Applicant: Sonova AG, Stafa (CH)

(72) Inventor: Hilmar Meier, Herrliberg (CH)

(73) Assignee: SONOVA AG, Stäfa (CH)

( * ) Notice: Subject to any disclaimer, the term of this patent is extended or adjusted under 35 U.S.C. 154(b) by 0 days.

(21) Appl. No.: 16/632,438

(22) PCT Filed: Jul. 20, 2017

(86) PCT No.: PCT/EP2017/068404

§ 371 (c)(1),
(2) Date: Jan. 20, 2020

(87) PCT Pub. No.: WO2019/015764

PCT Pub. Date: Jan. 24, 2019

(65) Prior Publication Data

US 2020/0162824 A1 May 21, 2020

(51) Int. Cl.

| | |
|---|---|
| ***H04R 25/00*** | (2006.01) |
| ***H04R 1/10*** | (2006.01) |
| ***H04R 1/32*** | (2006.01) |

(52) U.S. Cl.

CPC ..... *H04R 25/405* (2013.01); *H04R 1/1016* (2013.01); *H04R 1/326* (2013.01); *H04R 25/65* (2013.01); *H04R 2201/107* (2013.01); *H04R 2225/025* (2013.01)

(58) Field of Classification Search

CPC .. H04R 1/1066; H04R 1/1041; H04R 1/1016; H04R 1/326; H04R 2201/107; H04R 2225/025; H04R 25/405; H04R 25/65

USPC ..... 381/312

See application file for complete search history.

(56) References Cited

U.S. PATENT DOCUMENTS

| | | | | |
|---|---|---|---|---|
| 2010/0027824 | A1 | 2/2010 | Atamaniuk | |
| 2010/0092016 | A1 | 4/2010 | Iwano | |
| 2018/0139531 | A1 * | 5/2018 | Christiansen | H04R 1/1066 |
| 2018/0310089 | A1 * | 10/2018 | Yun | H04R 1/105 |

(Continued)

FOREIGN PATENT DOCUMENTS

| | | | | |
|---|---|---|---|---|
| DE | 299 23 767 | U1 | 5/2001 | |
| WO | 2007/028246 | A1 | 3/2007 | |
| WO | WO-2007028659 | A1 * | 3/2007 | H04R 25/656 |

(Continued)

OTHER PUBLICATIONS

International Search Report for PCT/EP2017/068404 dated Mar. 19, 2018.

*Primary Examiner* — Phylesha Dabney
(74) *Attorney, Agent, or Firm* — Pearne & Gordon LLP

(57) ABSTRACT

A hearing device including a housing, at least two microphones, and a sound receiving arrangement coupled to the housing such to span across the tragus of the user's ear in a direction from the rear of the user's head to the front of the user's head. The sound receiving arrangement includes a case formed with at least two openings adapted to allow sound entrance from the environment to the at least two microphones, respectively, wherein the openings are formed in portions of the sound receiving arrangement such that one of the at least two openings is located in front of the tragus and one is located rear the tragus.

18 Claims, 5 Drawing Sheets

(56) References Cited

U.S. PATENT DOCUMENTS

2019/0182575 A1* 6/2019 Julstrom ..... H04R 1/1083

FOREIGN PATENT DOCUMENTS

WO 2007/147415 A1 12/2007
WO 2008/012401 A1 1/2008

* cited by examiner

HEARING DEVICE, A SOUND RECEIVING ARRANGEMENT, A SET OF PARTS AND A HEARING DEVICE SYSTEM

TECHNICAL FIELD

The present invention is related to a hearing device, a sound receiving arrangement, a set of parts and a hearing device system.

BACKGROUND OF THE INVENTION

Hearing devices are typically used to improve the hearing capability or communication capability of a user. A hearing device may pick up the surrounding sound with a microphone of the hearing device, process the microphone signal thereby taking into account the hearing preferences of the user of the hearing device and providing the processed sound signal into a hearing canal of the user via a miniature loudspeaker, commonly referred to as a receiver. A hearing device may also receive sound from an alternative input such as an induction coil or a wireless interface.

People with hearing difficulties can suffer lack of intelligibility, in particular in case of adverse acoustical conditions. An approach for enhancing intelligibility in such situations might be in beamforming. In order to achieve beamforming, hearing devices are known which comprise a microphone system consisting of directional microphone systems.

Currently known hearing devices provide poor directivity, e.g. when measured as directivity index (DI) of the beamforming. Even if the microphone orientation can be designed very close to the optimum of zero degree, the directivity of the beamforming can highly depend on the individual pinna design. In case of hearing devices using two microphones, the microphone openings thereof can be close to each other which might however increase the noise floor at low frequencies. Further, the microphones are placed behind the Concha of the ear of the user. However, for signals arriving from the front, the concha represents an acoustical obstacle, in particular for frequencies above 1-2 kHz. Further, hearing devices are known which are customized in their outer shapes. However, customizing requires laborious ear impression taking, preform elaboration, complex manufacturing, etc., resulting in increased costs.

Document WO 2007/147415 A1 discloses a hearing aid with a flexible elongate member that is adapted for positioning in the pinna outside the ear canal of the user. Document U.S. Pat. No. 6,704,423 B2 discloses a hearing aid assembly having a mounting arm comprising a directional microphone mounted therewith.

It is an object of the present invention to provide a hearing device eliminating the problems known in the art.

SUMMARY OF THE INVENTION

The present invention is directed to a hearing device comprising a housing for accommodating a receiver, wherein said housing comprises a component adapted to be positioned at least partially into an ear canal of a user; and at least two microphones. Said hearing device further comprises a sound receiving arrangement in form of an arm which in the context of this invention is also referred to as the outer arm. Said sound receiving arrangement or rather outer arm is coupled to the housing such to span across the tragus of the user's ear in a direction from the rear of the users head to the front of the users head once the hearing device housing is inserted into the ear canal of the user, wherein said sound receiving arrangement comprises a case formed with at least two openings adapted to allow sound entrance from the environment to the at least two microphones, respectively, wherein the openings are formed in portions of the sound receiving arrangement such that one of the at least two openings is located in front of the tragus and one is located rear the tragus. Hence, provided is a hearing device comprising a sound receiving arrangement which case thereof is formed with two openings for allowing sound entrance from the environment to the at least two microphones. The openings are formed in portions of the case of the sound receiving arrangement such that one of the two openings is located in front of the tragus and one of the two openings is located rear the tragus. Compared to arrangements known in the art, the inventive hearing device allows a design of a beamforming with a significantly higher directivity index (DI). A significant acoustical impact can be above 1 kHz due to a super-positioning of the natural pinna-effect.

In an embodiment of the proposed hearing device the openings are formed at respective ends along an axis of the case of the sound receiving arrangement. Advantageously, this arrangement can reduce interference with the tragus since one microphone is behind the tragus and one microphone is in front of the tragus. Compared to hearing device arrangements known in the art, the inventive hearing device allows a design of a beamforming with a significantly higher directivity index (DI).

In an embodiment of the proposed hearing device the sound receiving arrangement is coupled to the housing via a spacer. Advantageously, the spacer can allow to bypass the tragus such to reliably reduce or rather eliminate interference with the tragus.

In an embodiment of the proposed hearing device the sound receiving arrangement and the hearing device housing are rotatable in relation to each other. Hence, the present invention allows the user to rotate the sound receiving arrangement in relation to the housing. Therefore, directivity, e.g. measured as directivity index (DI) of the beamforming, can be enhanced.

In an embodiment of the proposed hearing device the microphones are accommodated into the case. In this embodiment, the microphones can be placed adjacent to the openings formed into the case of the sound receiving arrangement.

In an embodiment, the hearing device further comprises a third microphone and a third opening allowing sound entrance to the third microphone. Therefore, directivity can be further enhanced. In an embodiment, the third opening is formed into the housing. In a further embodiment, the third opening is formed into the case of the sound receiving arrangement.

In an embodiment of the proposed hearing device the sound receiving arrangement is formed elongated or bended. The bended sound receiving arrangement can allow to proper bypass the tragus without the need of any additional components. In case of the sound receiving arrangement is formed elongated, an additional spacer can be interposed in order to bypass the tragus.

The present invention is further related to a sound receiving arrangement adapted to be coupled to a housing of a hearing device according to one of claims 1 to 9. The inventive sound receiving arrangement, which in the context of the present invention is also referred to as the outer arm, allows improved beamforming at ear level without the requirement of custom hearing device design. Therefore, so called "one-fits-all product designs" can be provided. Further, the hearing device, if provided with the inventive sound receiving arrangement, can be less sensitive to degradation of directivity due to pinna interferences of the individual human ear geometry, less sensitive to microphone tilt due to individual human ear geometry, etc. Further, the inventive sound receiving arrangement can achieve own voice pick-up for "headset" functions.

In an embodiment, the sound receiving arrangement comprises a case formed with at least two openings adapted to allow sound entrance from the environment to at least two microphones, respectively, wherein the openings are formed in portions of the sound receiving arrangement such that one of the at least two openings is located in front of the tragus and one is located rear the tragus. The inventive sound receiving arrangement can avoid degradation of directivity due to tragus interferences of the individual human ear geometry. In an example, additionally or as an option, degradation of directivity due to pinna interferences can be avoided, as well.

In an embodiment, the sound receiving arrangement is adapted to be coupled to the housing directly or via a spacer. The spacer can be formed and dimensioned such to, once sandwiched between the housing of the hearing device and the case of the sound receiving arrangement, proper bypass the tragus.

In an embodiment, the sound receiving arrangement is adapted to establish an electrical or acoustical connection to a receiver comprised in the housing of the hearing device. In an example, assuming the microphones are comprised into the case, the electrical signals output from the microphones can be transmitted to the receiver via electrical connections. In another example, assuming the microphones are comprised into the housing, sound received via the openings formed into the case of the sound receiving arrangement can be transmitted to the receiver via an acoustic path, e.g. an acoustic tube.

In an embodiment, the sound receiving arrangement, once connected to the housing, is bended such to avoid interference with the tragus. The sound receiving arrangement can be bended such to proper bypass the tragus.

In an embodiment, the sound receiving arrangement is adapted to be rotatable in relation to the housing. Hence, the user is allowed to adjust directivity of incoming sound by simply pivoting the sound receiving arrangement.

Moreover, the present invention is directed to a set of parts, comprising a hearing device housing and a sound receiving arrangement according to one of claims 10 to 15.

In an embodiment, the set of parts comprises a further sound receiving arrangement or a spacer, wherein a selection of sound receiving arrangements or the spacer allows assembly of a hearing device taking into account at least one of: a shape of the tragus of the user; activities of the user, such as sports, business, cultural and social activities; desired color of the sound receiving arrangement. In an example, the user can individually select sound receiving arrangements or the spacer such to allow the sound receiving arrangement to proper bypass the tragus. In another example, the selection can be based on a variety of activities, such as sports activities, more or less stationary activities, sitting in a restaurant, visiting a museum, etc. The user is further allowed to select a sound receiving arrangement which color best matches the individual outfit of the user. In another example, the selection can be based on a compromise between performance and less visibility.

Moreover, the present invention is directed to a hearing device system comprising at least one hearing device according to one of claims 1 to 9.

It is expressly pointed out that any combination of the above-mentioned embodiments is subject of further possible embodiments. Only those embodiments are excluded that would result in a contradiction.

BRIEF DESCRIPTION OF THE DRAWINGS

The present invention is further described with reference to the accompanying drawings jointly illustrating various exemplary embodiments which are to be considered in connection with the following detailed description. What is shown in the figures is.

DETAILED DESCRIPTION OF THE INVENTION

Figure 2A:
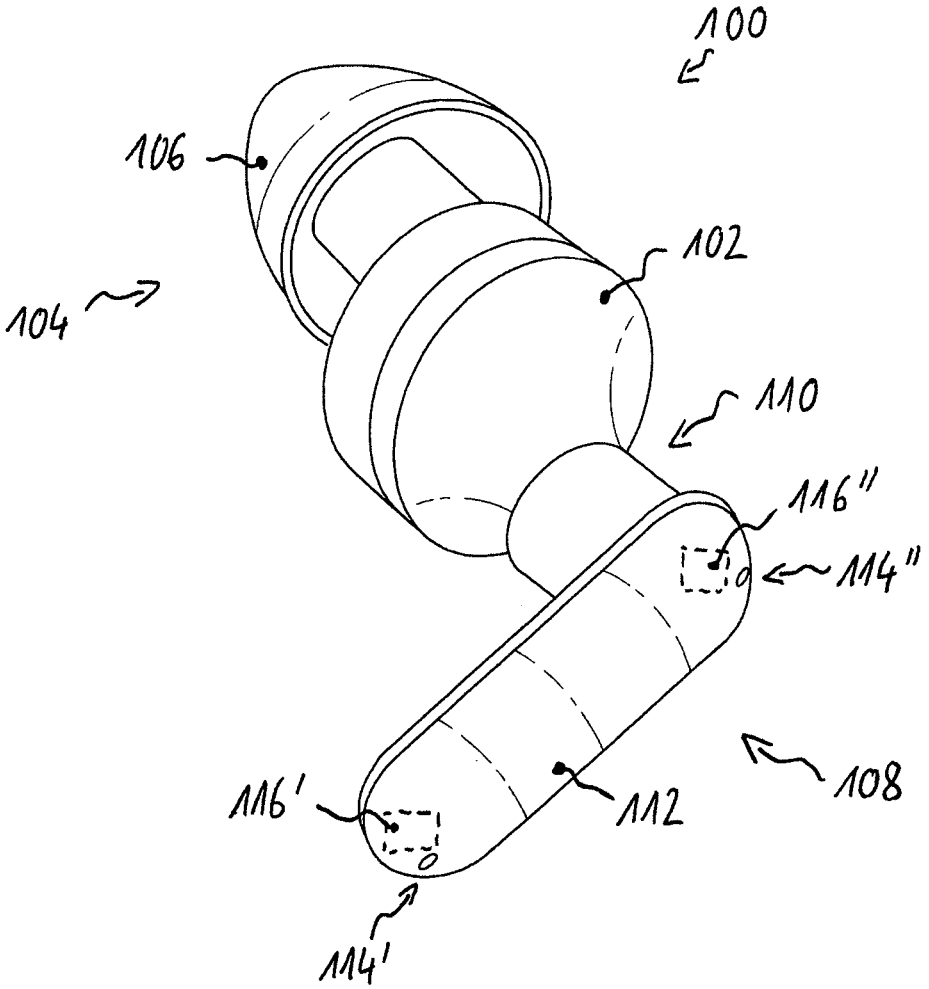
FIGS. 2A-C depict a hearing device in a first aspect of the invention in different views.
Figure 2B:
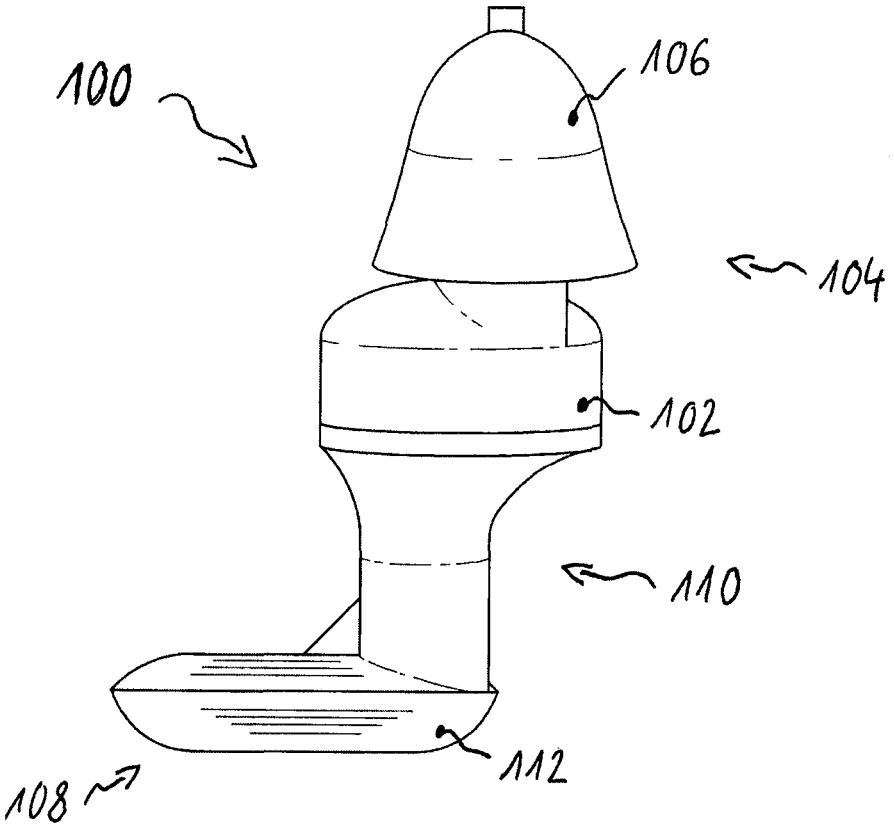
Figure 2C:
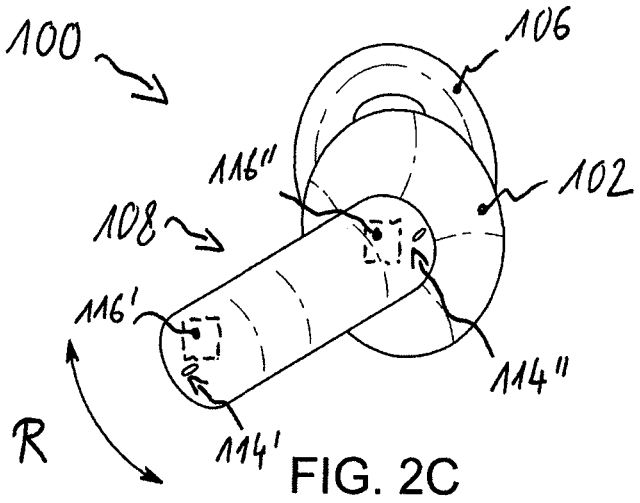

FIGS. 2A-C show different views of a hearing device 100 in a first aspect of the invention. While the hearing device 100 is shown to be configured as an in-the-ear (ITE) hearing aid, the hearing device can be configured from a plurality of devices providing hearing capabilities, including also e.g. headset functions, etc. The hearing device 100 comprises a housing 102 for accommodating a receiver, processing means, battery (not shown), etc. Said hearing device 100 further comprises an ear plug 104 configured as a component adapted to be positioned at least partially into an ear canal of a user. The housing 102 and the ear plug 104 can be formed integrally. The ear plug 104 can comprise a conically shaped replaceable resilient means 106, adapted to establish a snuggle fit connection against the ear canal wall once inserted. The hearing device 100 further comprises a sound receiving arrangement 108 which in the context of the present invention is also referred to as an outer arm 108. The outer arm 108 is coupled to the housing 102, wherein the coupling to the housing 102 can be rotationally or fixed by means of a spacer 110. While the spacer 110 is shown to be integrally formed with the outer arm 108, the spacer 110 can be integrally formed with the housing 102 or can be a separate component which can be coupled between the housing 102 and the outer arm 108.

According to the invention, the outer arm 108 is coupled to the housing 102 such to span across the tragus of the user's ear in a direction from the rear of the user's head to the front of the user's head once the hearing device housing 102 (by its ear plug 104) is inserted into the ear canal of the user. The outer arm 108 comprises a case 112 formed with at least two openings 114',114" adapted to allow sound entrance from the environment to at least two microphones 116',116", which are respectively inserted into the case 112. In the figures, the microphones 116',116" are schematically indicated by means of a dashed rectangle. The openings 114',114" are formed in portions of the case 112 of the outer arm 108 in front of and rear the tragus (also refer to FIG. 4). In other words, the openings 114',114" are formed at respective ends along an axis of the case 112 of the outer arm 108. This arrangement allows the design of a beamforming with a significantly higher directivity index (DI). Further, the openings 114',114" are spaced apart from each other at a maximum value, resulting in reduced noise floor at lower frequencies.

In the aspect as shown in FIGS. 2A-C (in particular as highlighted in FIG. 2C), the outer arm 108 and the housing 102 of the hearing device 100 can be rotatable in relation to each other. In FIG. 2C, the directions of rotation are depicted by means of a double arrow R. Thus, the user can rotate the outer arm 108 such to achieve efficient adjustment of the directivity of the beamforming of the hearing device 100 depending on e.g. the individual tragus design of the user.

While the microphones 116',116" are shown to be accommodated into the case 112 of the outer arm 108 in positions adjacent to the openings 114',114", respectively, the microphones 116',116" can be positioned within the housing 102. In the latter case, the sound entered via the openings 114',114" can be transmitted to the microphones via acoustical paths, e.g. sound tubes (not shown).

While not shown, the hearing device 100 can further comprise a third microphone and a third opening allowing sound entrance to the third microphone, wherein the third opening can be formed into the housing 102 or the case 112 of the outer arm 108. The provision of the third microphone can allow improved directivity of the hearing device 100.

Figure 3:
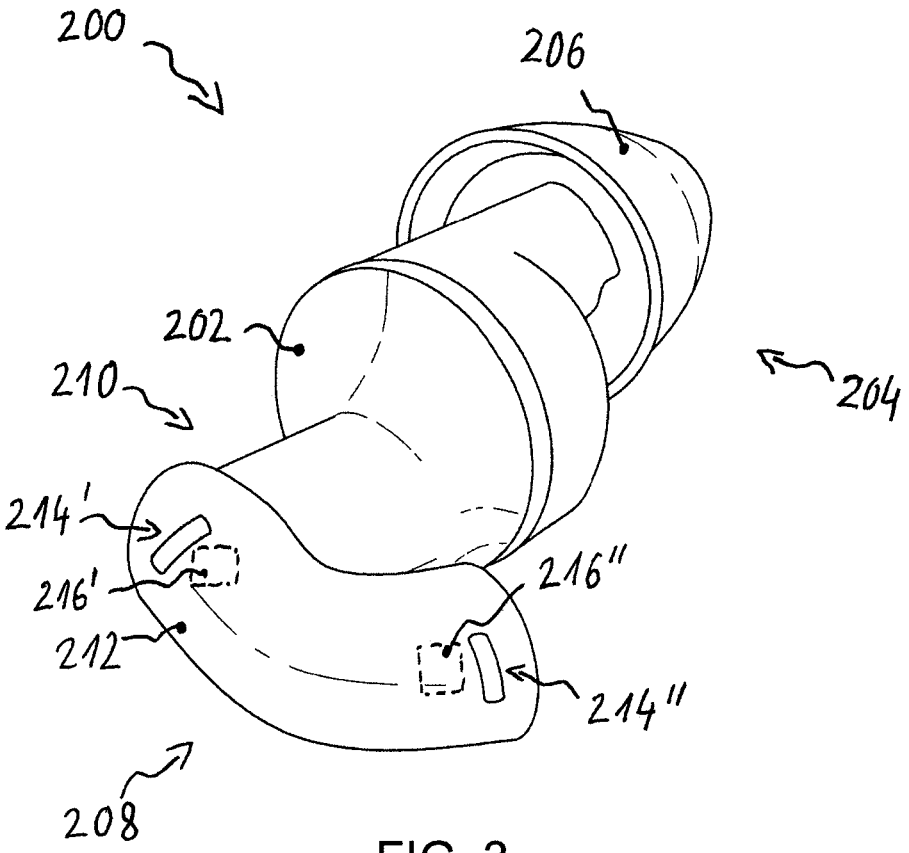
FIG. 3 depicts a hearing device in a second aspect of the invention.
Figure 4:
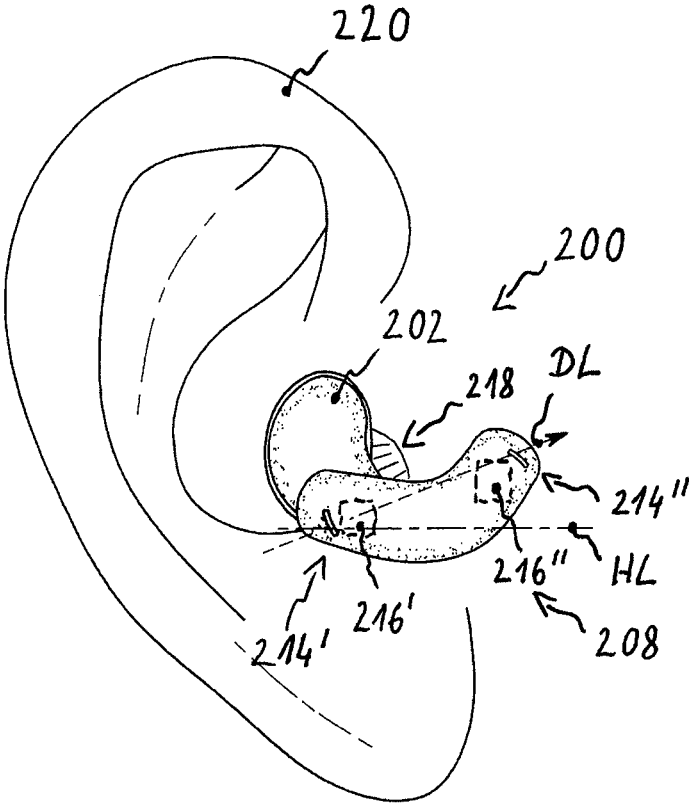
FIG. 4 depicts the hearing device in the second aspect of the invention, fitted into the ear canal of a user.

FIGS. 3 and 4 depict a hearing device 200 in a second aspect of the invention. In particular, FIG. 3 shows the hearing device 200 in a perspective view, while FIG. 4 shows the hearing device 200 fitted into the ear 220 of a user. The hearing device 200 comprises a housing 202 and an ear canal plug 204 to be positioned into an ear canal of the user. In doing so, the ear plug 204 at its distal end can comprise a resilient means 206 allowing a snuggle fit connection to the ear canal wall of the user once inserted. The housing 202 and the ear plug 204 can be formed integrally. The hearing device 200 further comprises an outer arm 208 coupled to the housing 202. Said outer arm 208 comprises a case 212 formed with two openings 214',214" which allow sound entrance from the environment to a first 216' and second 216" microphones, respectively. The microphones 216',216" are accommodated inside the case 212 in positions adjacent to said openings 214',214", respectively. The openings 214', 214" are formed in portions of the outer arm 208 in front of and rear a tragus 218 of the user's ear 220, as shown in FIG. 4. Therefore, the first opening 214' is positioned behind the tragus 218 and the second opening 214" is positioned in front of the tragus 218. Therefore, interference with the tragus 218 can be avoided. Further, the design of a beamforming with a significantly higher directivity index (DI) can be achieved.

Figure 1:
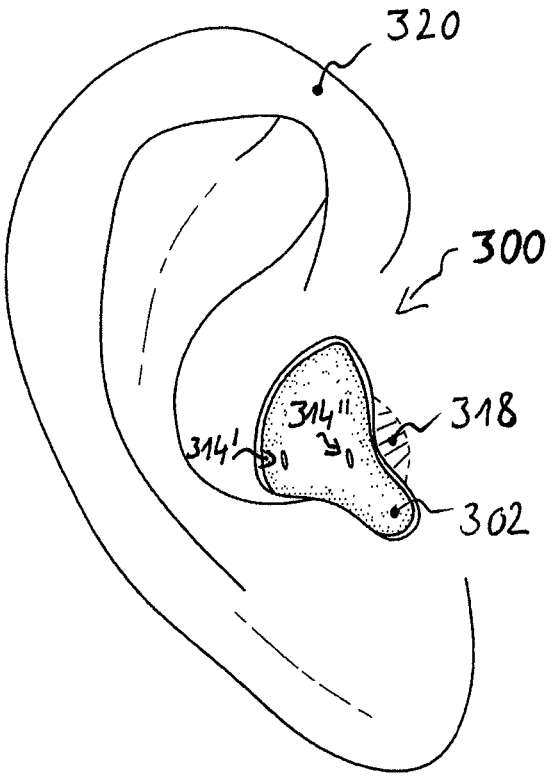
FIG. 1 Prior Art
FIG. 1 depicts a hearing device according to the prior art, fitted into the ear canal of a user.

In the shown aspect, the case 212 of the outer arm 208 is formed bended. Therefore, interference with the tragus 218 can be avoided. In other words, the tragus 218 can be bypassed. Assuming the first opening 214' forms a pivot point, the bended shape of the outer arm 208 allows that a directivity line DL, virtually connecting the openings 214', 214" to each other, is rotated or rather shifted in relation to a horizontal line HL by a predetermined angle, as shown in FIG. 4. This angle is adjustable by the user. Since the two microphone openings 214',214" are spaced apart from each other at a maximum value, the noise floor at low frequencies can be reduced FIG. 1 depicts a hearing device 300 according to the prior art, wherein the hearing device 300 is shown fitted into the ear 320 of a user. The hearing device 300 comprises a housing 302, wherein a portion thereof, which is exposed to the outside, is formed with two openings 314',314" for allowing sound entrance to two microphones (not shown). Hence, the openings 314',314" are lying on a single plane. As can be seen, both openings 314',314" are positioned behind the tragus 318. Therefore, the tragus 318 acts as an obstacle resulting in poor directivity characteristic. Further, even if the microphone orientation can be designed very close to the optimum of zero degree, the directivity of the beamforming highly depends on the individual pinna design. Further, the two microphone openings 314',314" are close to each other which increases the noise floor at low frequencies. Furthermore, the prior art hearing device 300 shows maximum sensitive to microphone tilt due to individual human ear geometry.

What is claimed is:

1. A hearing device (100;200), comprising:

a housing (102;202) for accommodating a receiver, said housing (102;202) comprises a component (104;204) adapted to be positioned at least partially into an ear canal of a user;

at least two microphones (116',116";216',216"); and a sound receiving arrangement (108;208) coupled to the housing (102;202) such to span across the tragus (218) of the user's ear in a direction from the rear of the user's head to the front of the user's head once the hearing device housing (102;202) is inserted into the ear canal of the user, wherein said sound receiving arrangement (108;208) comprises a case (112;212) formed with at least two openings (114',114";214',214") adapted to allow sound entrance from the environment to the at least two microphones (116',116";216',216"), respectively, wherein the openings (114',114";214',214") are formed in portions of the sound receiving arrangement (108;208) such that one of the at least two openings (114',114";214',214") is located in front of the tragus (218) and one is located rear the tragus (218).

2. The hearing device (100;200) according to claim 1, wherein the openings (114',114";214',214") are formed at respective ends along an axis of the case (112;212) of the sound receiving arrangement (108;208).

3. The hearing device (100;200) according to claim 1, wherein the sound receiving arrangement (108;208) is coupled to the housing (102;202) via a spacer (110;210).

4. The hearing device (100;200) according to claim 1, wherein the sound receiving arrangement (108;208) and the hearing device housing (102;202) are rotatable in relation to each other.

5. The hearing device (100;200) according to claim 1, wherein the microphones (116',116";216',216") are accommodated into the case (112;212).

6. The hearing device (100;200) according to claim 1, comprising a third microphone and a third opening allowing sound entrance to the third microphone.

7. The hearing device (100;200) according to claim 6, wherein the third opening is formed into the housing (102; 202).

8. The hearing device (100;200) according to claim 6, wherein the third opening is formed into the case (112;212) of the sound receiving arrangement (108;208).

9. The hearing device (100;200) according to claim 1, wherein the sound receiving arrangement (108;208) is formed elongated or bended.

10. A sound receiving arrangement (108;208) adapted to be coupled to a housing (102;202) of a hearing device (100;200) according to claim 1.

11. The sound receiving arrangement (108;208) according to claim 10, comprising a case (112;212) formed with at least two openings (114',114";214',214") adapted to allow sound entrance from the environment to at least two microphones (116',116";216',216"), respectively, wherein the openings (114',114";214',214") are formed in portions of the sound receiving arrangement (108;208) such that one of the at least two openings (114',114";214',214") is located in front of the tragus (218) and one is located rear the tragus (218).

12. The sound receiving arrangement (108;208) according to claim 10, adapted to be coupled to the housing (102;202) directly or via a spacer (110;210).

13. The sound receiving arrangement (108;208) according to claim 10, adapted to establish an electrical or acoustical connection to a receiver comprised in the housing (102;202) of the hearing device (100;200).

14. The sound receiving arrangement (108;208) according to claim 10, wherein the sound receiving arrangement (108;208), once connected to the housing (102;202), is bended such to avoid interference with the tragus (218).

15. The sound receiving arrangement (108;208) according to claim 10, wherein the sound receiving arrangement (108;208) is adapted to be rotatable in relation to the housing (102;202).

16. A set of parts, comprising a hearing device housing (102;202) and a sound receiving arrangement (108;208) according to claim 10.

17. The set of parts according to claim 16, comprising a further sound receiving arrangement or a spacer, wherein a selection of sound receiving arrangements or the spacer allows assembly of a hearing device (100;200) taking into account at least one of:

a shape of the tragus of the user, activities of the user, such as sports, business, cultural and social activities, desired color of the sound receiving arrangement.

18. A hearing device system comprising at least one hearing device (100;200) according to claim 1.

* * * * *